US005871119A

United States Patent [19]

Blackinton, Jr.

[11] Patent Number: 5,871,119

[45] Date of Patent: Feb. 16, 1999

[54] INK DISPENSING CONTAINER

[76] Inventor: Richard E. Blackinton, Jr., 250 Willow Glen Dr., Marietta, Ga. 30068

[21] Appl. No.: 684,552

[22] Filed: Jul. 19, 1996

[51] Int. Cl.[6] ..... G01F 11/00

[52] U.S. Cl. ..... 222/1; 222/105; 222/107; 222/154

[58] Field of Search ..... 222/1, 92, 94, 222/105, 107, 154, 568

[56] References Cited

U.S. PATENT DOCUMENTS

| | | | |
|---|---|---|---|
| 2,207,294 | 7/1940 | Hubner et al. | 222/107 X |
| 2,649,995 | 8/1953 | Muskin | 222/92 |
| 5,275,311 | 1/1994 | Piarrat | 222/105 X |
| 5,332,121 | 7/1994 | Schmidt et al. | 222/105 X |

FOREIGN PATENT DOCUMENTS

| | | | |
|---|---|---|---|
| 340750 | 5/1936 | Italy | 222/92 |
| 4339769 | 11/1992 | Japan | 222/105 |
| 5042979 | 2/1993 | Japan | 222/154 |

OTHER PUBLICATIONS

Package Supply & Equipment Co, Inc. Catalog, p. 93 Sep. 1993.

*Primary Examiner*—Joseph A. Kaufman
*Attorney, Agent, or Firm*—Womble Carlyle Sandridge & Rice

[57] ABSTRACT

An ink dispensing container for storage, transport and dispensing of printing ink. The ink dispensing container includes a flexible container body having a lid removably mounted at one end for sealing the container body. Ink is dispensed from the container body by applying pressure to the sides of the container body so as to urge the ink out of the container body. Thereafter, the container body can be resealed by reapplying the lid thereto, while continuing the exert pressure on the side wall of the container body so as to evacuate substantially all the air therefrom prior to completely resealing the container body.

10 Claims, 2 Drawing Sheets

INK DISPENSING CONTAINER

FIELD OF THE INVENTION

The present invention relates in general to a container for transporting, storing and dispensing ink. In particular, the present invention relates to a flexible container for storing, transporting and dispensing printing ink, which container has a flexible side wall and resealable cap(s) to enable ink to be removed from the container in a controlled manner and which can be resealed with any air remaining within the container being substantially evacuated to prevent or greatly reduce skinning of the ink within the container.

BACKGROUND OF THE INVENTION

Printing inks of the type generally used for commercial printing of graphic materials such as brochures, flyers, posters and other, similar materials, generally are substantially viscous and sticky, having consistencies ranging from extremely thick and gelatinous to a pourable, syrupy consistency. In the past, it has been common to package such printing inks in standard sized metal cans. These cans typically are cylindrical sheet metal cans having a shallow slip-on lid that is adapted to be pried off and replaced over the cans for resealing the cans, similar to conventional paint cans. The inks generally are sold in standard sized containers of between one to ten pound increments, with five pound increments generally being a preferred standard size.

In use, an operator or worker removes the lid using his hands and, if necessary, a prying tool and then scoops or spoons out the ink from the container using a spreading tool akin to a large spoon or spatula. The ink is generally scooped onto and spread about a mixing or weighing table, or can be applied to a supply well for a printing press or directly onto the press itself. After a desired portion of ink has been extracted from the container, the metal top is replaced over the container and tapped down to reseal the container.

A principal problem with such cans traditionally has been that they are extremely awkward to handle and use. This makes the process of extracting the ink from the cans difficult and somewhat messy as the worker tries to hold the bulky five to ten pound can in one hand, or under one arm, while trying to spoon out the thick, gelatinous, sticky ink using the spreading tool with their other hand. Such a method does not enable much control as to how much and how the ink is deposited on the mixing/weighing table or press and is extremely messy, with the ink oftentimes covering not only the spreading tool but the sides of the table, the can, and the worker. As a result, extensive and time consuming cleanup of the work area and the spreading tool(s) is required.

In addition, when the lid is replaced on the can, it tends to trap air within the cans between the lid and the ink within the can. Because of the construction of the can, this air generally cannot be evacuated prior to the resealing of the can with its shallow metal lid. This air, when it comes into contact with the ink within the can, causes "skinning" of the ink wherein a relatively thick crust or layer of dried ink, a "skin", forms on the top of the ink. Such a crust or skin first must be removed and discarded before additional ink can be removed from the can. This process must be repeated each time the can is opened and ink extracted therefrom until the can is empty. This creates a significant amount of waste of ink, upwards of 10% of the ink in the can, due to the continual skinning of the ink within the can. Also, if the can is not completely sealed, the ink can become dried out and thus wasted.

Further, EPA regulations classify printing inks as a toxic substances, and thus require that substantially all of the ink be removed from ink cans, with less than 1% of the volume of ink being left within the can in order for the cans to be discarded. Thus, the cans must be completely and carefully scraped and cleaned of ink prior to disposal of the can. Again, this is a messy, time consuming and somewhat difficult job that also increases the clean-up time and costs of using the cans. The cans'bulk further creates increased expense in shipping and storing, as even empty cans take up a significant amount of space, which space cannot be recaptured until all of the ink is completely exhausted from the cans and the cans are discarded.

Recently, attempts have been made to package printing inks in smaller size amounts in paper and/or plastic "caulking tubes" from which the ink can be dispensed using a caulking gun. Such tube containers appear to be sufficient for delivering or dispensing some printing inks in approximately one pound increments. However, for increments above one pound and for more viscous inks, these caulking tube type containers are not practical. Given the high viscosity of printing inks, as greater than one pound increments are used in the tubes, the pressure created within the tubes as the ink is attempted to be forced out of the ends of the tubes, generally tends to split the seams connecting the spout and lid to the tube body, in addition to splitting the tube itself causing leakage, etc. To prevent such splitting, it generally is necessary to use thicker, heavier gauge plastics and paper or other stronger, more expensive materials for tubes containing greater than one pound increments of printing and other types of inks, leading to greater expense. In addition, stronger, heavier gauge caulking guns or applicator tools also generally are required to enable sufficient force to be exerted on the sliding bottoms of the caulking tubes to force the ink out of the tubes. This further increases the expense of using such caulking tube type delivery systems by requiring special applicators or guns.

Accordingly, it can be seen that a need exists for a container for the storage, transport and dispensing of printing inks that is easy and economical to use and which can be used for storing and dispensing varying amounts of printing inks without requiring special tools and without creating a mess or requiring extensive clean up, while substantially reducing the incidence of waste of the printing inks due to skinning.

SUMMARY OF THE INVENTION

Briefly described, the present invention comprises an ink dispensing container for containing a supply of printing ink for storage, transport and for dispensing the ink onto a mixing or printing table or printing press. The ink dispensing container includes a substantially cylindrically shaped container body having a substantially cylindrical side wall, a closed first or lower end, and an open second or upper end. The container body typically is formed from a high strength, resilient plastic material having sufficient flexibility to enable the container body to be compressed, while retaining sufficient strength to support and contain the printing ink within the container body without rupturing or leaking in response to pressure within the container body due to the squeezing or compression of the heavy, viscous printing ink within the container body.

A collar is mounted about the open second end of the container body. The collar typically is formed from a hard plastic material such as polyvinylchloride or similar substantially rigid, durable material. The collar includes a helical thread formed thereabout and defines a large diameter aperture or main body opening into the container body. A lid member or cover is mountable to the collar in order to seal the open upper end of the container body. The lid can have flat or straight surfaces about its outer periphery to create stability when stored or laid down, and typically is formed from the same plastic material as the collar. The lid is of a diameter slightly greater than the diameter of the body opening defined by the collar, and includes a helical thread formed along its interior side surface. The threads of the collar and lid engage one another as the lid is applied over the collar so as to enable the lid to be releasably attached to the open upper end of the container body for sealing the large diameter body opening of the container body in a substantially air-tight arrangement.

A small diameter spout is formed approximately in the center of the body of the lid. The spout is of a substantially reduced diameter from that of the opening defined by the collar, typically approximately ½ to 1½ inches, and defines a small diameter orifice for the container. The spout includes an outwardly projecting, substantially cylindrically shaped side wall having a helical thread formed about its upper end. A cap having a helical thread formed about its body and adapted to engage and mate with the helical thread of the spout for sealing the spout. As a result, the lid with its integral smaller diameter spout provides greater control of the dispensing of ink from within the container.

If substantially all of the ink from the container is to be used, the large lid is removed from the collar, exposing the large diameter main body opening of the container. The side wall of the container body is compressed or squeezed so as to urge the ink from within the container and onto a printing table, mixing table or the like. As the ink is dispensed from the container, the container body generally is flattened so as to substantially exhaust the container body of ink as the ink is dispensed therefrom. For dispensing smaller quantities of ink and to dispense the ink in more precise locations, such as on a printing press or in an ink well, the cap of the spout is removed and the ink dispensed through the spout as the side wall of the container body is compressed.

Once a desired quantity or portion of ink has been delivered or dispensed from the container, the container is resealed by reapplying the large diameter lid, or the small diameter cap of the spout. As the container is resealed, the worker also generally squeezes the side wall of the container body until the ink therewithin substantially fills the spout of the lid member. This causes substantially all the air remaining in the container body to be exhausted from the container body. Thereafter, the small diameter cap is replaced over the spout and tightened against the body of the lid to seal the container with substantially all of the air from within the ink dispensing container having been removed.

Various objects, features and advantages of the present invention will become apparent to those of ordinary skill of the art upon a review of the following detailed description, when taken in conjunction with the accompanying drawings.

DETAILED DESCRIPTION OF THE PREFERRED EMBODIMENT

Figure 1:
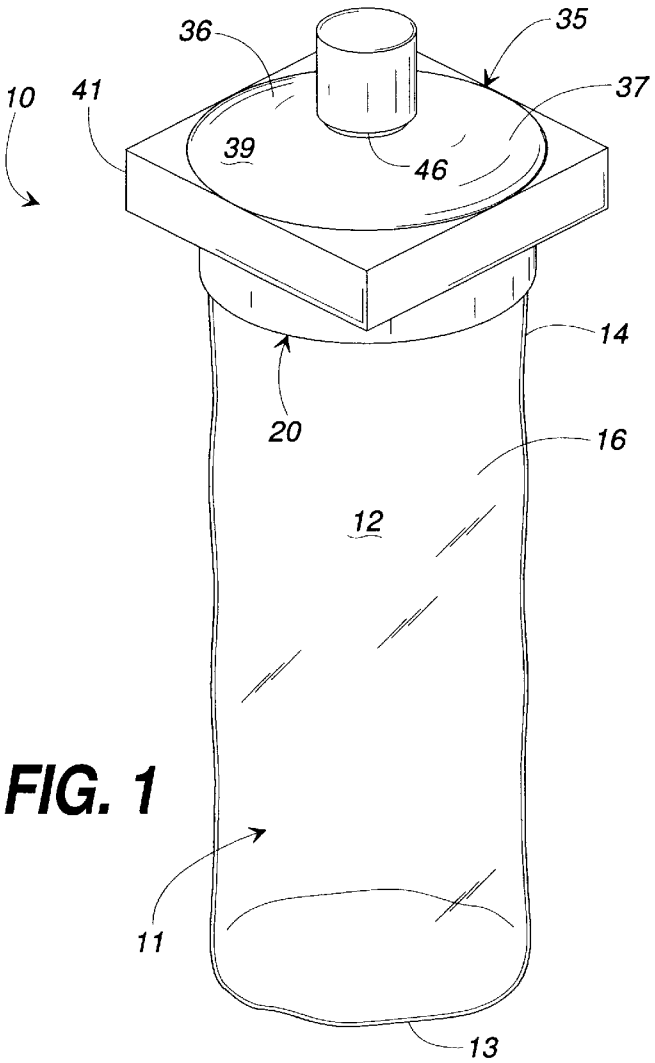
FIG. 1 is a perspective view of the ink dispensing container of the present invention.

Referring now in greater detail to the drawings in which like numerals indicate like parts throughout the several views, FIG. 1 generally illustrates the ink dispensing container 10 for containing, transporting and dispensing printing inks of various weights and consistencies for use in graphical printing applications. The ink dispensing container 10 generally is formed as a substantially cylindrically shaped bag or similar container, although other configurations or shapes can be used as desired. The ink dispensing container includes a container body 11 that is formed from a strong, flexible, substantially air-tight material.

Typically, the container body is formed from a flexible plastic material, including being formed from urethane, chloroprene, buna-n, cloth inserted rubber, elastomeric rubber, flouroelastomers, hypalon plastic, neoprene, nitrile, nylon, lycra, polyurethane, prismatic films, polyolefin films, polyvinylchloride, polyethylene, rubber, polypropylene, polytetraflourine, vinyl, viscoelastic fabric, and vinyl laminated fabric, or similar high strength, flexible material. The material used is selected to have sufficient flexibility to enable the container body to be compressed, squeezed or otherwise manipulated for urging a portion of ink out of the container body, but still have sufficient strength to support and contain a large volume of heavy, viscous printing ink without rupturing or permitting the ink to leak out of the container body as the pressure within the container body due to the squeezing of the viscous printing ink increases with compression of the container body. In addition, the material used for the container body typically is transparent to enable the color of the ink stored within the container body to be readily viewed and identified by workers so as to avoid potential problems with mislabeling of the ink dispensing containers, and to provide an easier means for cataloging and segregating printing inks of varying colors.

The container body 11 generally is between 10 to 20 inches in length and approximately ¾ of an inch to approximately 6 inches in diameter. The exact size of the container depends upon the volume or amount of printing ink to be received an stored within the ink dispensing container. Typically, the ink dispensing container will come in sizes of between one pound to approximately ten pounds, with the standard size generally being a five pound size container. The container body, as shown in FIG. 1, includes a substantially cylindrical side wall 12, a first or lower closed end 13, and an open second or upper end 14. The closed first end of the container body generally is hermetically sealed to provide an air tight seal, although it can also be sealed using adhesive, mechanical or other bonding means. In addition, the side wall 12 can taper slightly as it extends from the upper open end toward the lower closed end of the container body. The side wall and closed and open ends of the container body thus define an open ended pouch or receptacle 16 (FIG. 2A) in which printing ink is received and stored.

Figure 2A:
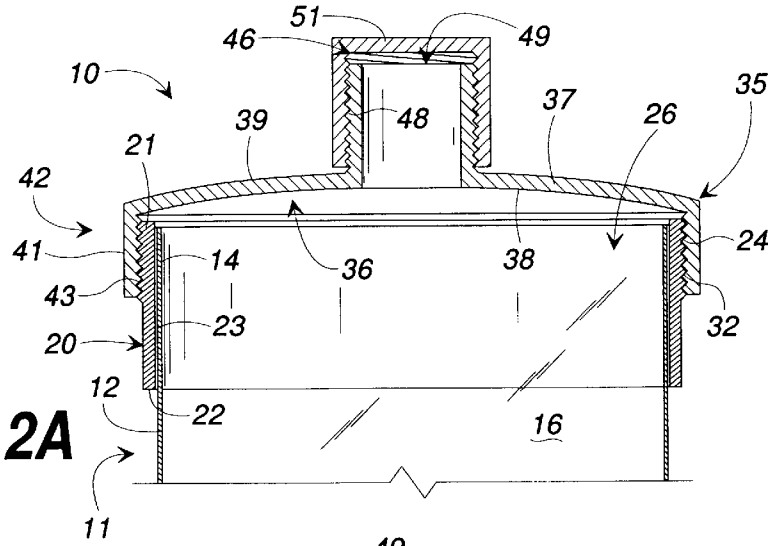
FIG. 2A is a side elevational view, taken in partial cross-section of the ink dispensing container of FIG. 1, illustrating the connection of the collar to the open upper end of the container body.

As illustrated in FIGS. 1 and 2A, a rigid collar 20 is mounted to the container body, circumscribed about the open upper end 14 thereof. The collar generally is a sleeve or cylinder approximately ¼ to 1/16 inch thick and having a diameter approximately equivalent to the diameter of the open upper end of the container body. The collar further is formed from a rigid, durable plastic material, such as nylon, polyvinylchloride or an acetal resin such as Delrin® or, other similar durable, lightweight materials can be used as well. The collar has an upper end 21, a lower end 22, and an interior side wall 23 and an exterior side wall 24. The upper end 14 of the container body generally is attached to the interior side wall 23 of the collar 20 by an adhesive or a similar bonding agent, or mechanical pressure clamp, to seal the collar to the upper end of the container body. The collar thus defines a main body opening or aperture 26 through which a large volume of the printing ink can be evacuated or dispensed from the container body. The collar further provides strength and rigidity to the open upper end of the container body to enable dispensing of the ink from the container body without danger of collapse or tearing of the side wall of the container body.

Figure 2B:
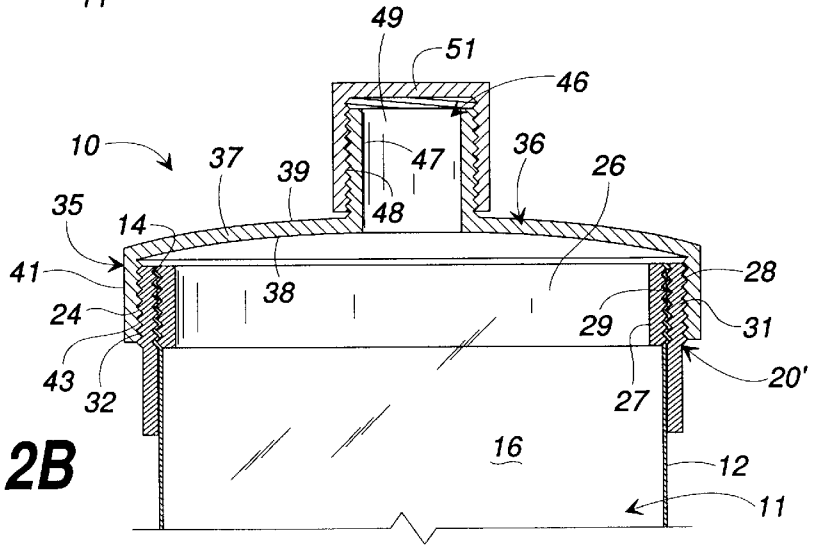
FIG. 2B is a side elevation view taken in partial cross-section of the ink dispensing container, showing an additional embodiment of the collar connected to the upper end of the side wall of the container body.

FIG. 2B illustrates an additional embodiment 20' of the collar in which the collar is formed from two pieces, including an inner section 27 and an outer section 28. The sections have opposed, mating threads 29 and 31. The side wall 12 of the container body is engaged between the opposing threads 29 and 31 of the inner and outer sections 27 and 28 of the collar 20' such that as the sections of the collar 20' are rotated with respect to one another, their threads tend to engage and mesh together, engaging and capturing the upper end of the side wall of the container body therebetween to thus attach the collar 20' to the container body, while still enabling the collar to be removed and reused as desired. In addition, the exterior side wall 24 of the collar includes a helical thread 32 formed about its circumference.

As shown in FIGS. 1 and 2A, a lid member 35 is received over an removably attaches to the collar 20 for sealing the container body with the ink contained therein. As with the collar, the lid 35 generally is formed from a substantially rigid plastic material such a polyvinylchloride, an acetal resin such as Delrin®, or a similar durable material. The lid 35 includes a lid body 36 of a size that is slightly greater than the diameter of the orifice or aperture defined by the collar 20. The lid body includes and upper, domed portion 37, having an interior surface 38 and an exterior surface 39. A series of substantially rectangular shaped side walls 41 depend downwardly from the upper portion 37, so as to form a substantially square-shaped base 42. The base can also be formed with more or less than four walls, having a triangular, pentagonal, or hexagonal shape as desired. The square shape of the base 42 provides a stable platform that enables the ink dispensing container 10 to be placed on its side during storage and/or transport or when not in use, without the danger of the ink dispensing container rolling or otherwise shifting.

As indicated in FIG. 2A, the interior surface of the base of the lid body is substantially circular and includes helical threads 43 circumscribed about the interior of the base 42, which threads engage the threads 32 of the exterior side wall 24 of the collar 20 for releasably attaching the lid to the collar in a substantially air-tight arrangement. When the lid is removed from the collar, the main body opening or aperture 26 of the container body 11 is opened so as to enable a substantial portion of the ink within the ink dispensing container to be dispensed or evacuated therefrom.

A smaller diameter spout 46 also generally is formed in the body 36 of the lid 35, typically for ink dispensing containers that are sized to hold greater than one pound increments of printing ink. The spout 46 is formed approximately in the center of the domed or upper portion 37 of the lid body 36 of the lid 35, projecting outwardly therefrom. The spout includes a cylindrical wall 47 having a helical thread 48 formed thereabout and defines a smaller diameter orifice or aperture 49. Typically, the spout has a diameter of approximately ½ to 1½ inches and is used for applications wherein smaller, more precise amounts of ink are to be dispensed and/or greater control of the dispensing of the ink is necessary. A small diameter cap 51 is provided and engages and screws down onto the spout to enclose and seal the small diameter orifice 49 of the spout.

Figure 3:
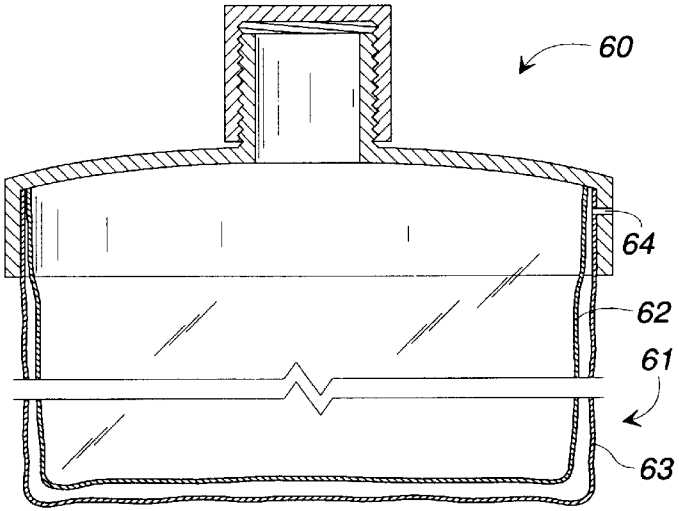
FIG. 3 is a side elevational view taken in partial cross-section of an additional embodiment of the ink dispensing container.

FIG. 3 illustrates an additional embodiment 60 of the ink dispensing container, in which the container body 61 includes an internal bag or container 62 contained within an external bag or container 63. The internal bag generally is formed from a lighter weight, thinner material to enable the internal bag to remain in closer contact and to fold and roll with the ink contained therein, while the external bag generally is formed from a much more rigid, thicker material. The external bag thus provides rigidity and support for the internal bag. In addition, the outer bag generally includes a small air hole 64 formed adjacent the upper end of the container body to enable a layer of air to be formed between the internal and external bags so as to provide additional pressure for urging the ink out of the container body.

OPERATION

Figure 4:
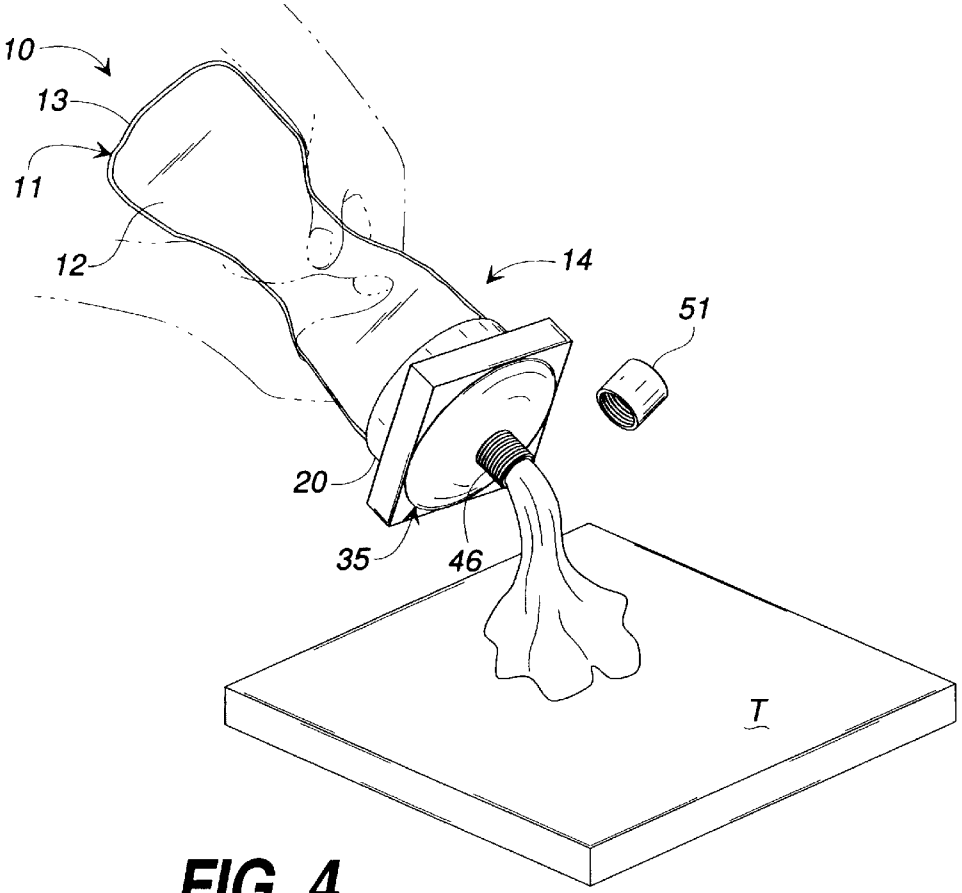
FIG. 4 is a perspective view illustrating the use of the ink dispensing container of the present invention for dispensing printing ink.

In use of the ink dispensing container 10 for dispensing printing ink "I" (FIG. 4) a worker, such as a printer, first unseals the ink dispensing container by removing either the entire lid member 35 or the cap 51 (FIG. 1) depending on the size job and amount of ink to be used. If a small portion of ink is to be dispensed or the ink is to be dispensed under conditions requiring greater control or precision, such as being dispensed into an inkwell of a printing press, the worker will remove the cap 51 so that the ink is dispensed through the orifice 49 (FIG. 2A) of the spout 46 of the lid 35 of the ink dispensing container. For jobs where larger portions or volumes of ink are required, the entire lid 35 generally is removed from the container body, to expose the main body opening 26 of the container body.

Thereafter, the worker compresses or squeezes the side wall 12 (FIG. 1) of the container body 11, while directing the spout orifice 49 (FIG. 2A) or main body opening 26 of the container body 11 at a desired area, to dispense or deposit a desired amount of ink on a mixing table "T" (FIG. 4), or directly on a printing press, etc. In addition, the worker can roll up the lower, closed end 13 of the container body 11 as the ink I is evacuated from the container body to maintain pressure against the ink. After a desired amount or volume of ink has been deposited on the mixing table T, etc. the worker reseals the ink dispensing container, if there is ink remaining therewithin.

If the large diameter lid has been removed for dispensing larger volumes of ink, the lid 35 is replaced over the open end of the container body, and the smaller diameter cap 51 for the spout 46 is removed. Thereafter, the worker compresses or applies force to the side wall 12 of the container body 11, generally squeezing and/or rolling up the closed lower end 13 of the container body so as to force the ink remaining within the container body upwardly against the interior surface 38 (FIG. 2A) of the lid and partially into the spout. As a result, any air remaining within the container body is caused to be substantially evacuated therefrom, prior to the replacement of the small diameter cap over the spout and thus the resealing of the container body.

This process is repeated for subsequent uses of the ink dispensing container, with the ink dispensing container being rolled up or flattened as ink is removed therefrom until all of the ink is exhausted from the ink dispensing container. At the start of each repeated use, the operator first removes any minimal layer of skin that might have accumulated at the very top of the spout. Such an amount of skin, is, however, significantly less than the thick, substantial layers of skin that generally tend to form with conventional metal can ink containers, thus saving considerable waste of ink. In addition, the ink dispensing container of the present invention can be substantially completely exhausted of ink contained therein during use as the ink is dispensed therefrom. Any residual ink can be easily and quickly removed simply by laying the container body flat and sliding a scraping means, such as a worker's hand or a block or bar, along the container body to flatten the container body. As the container body is flattened, any ink remaining therein is progressively urged out of the container body to substantially evacuate all of the ink from the container body. Thus, the container body is generally substantially cleaned of ink during use so that the ink dispensing container can be recycled for further use, or can be disposed of, with the ink having been substantially removed therefrom in compliance with EPA regulations.

Accordingly, it can be seen that the present invention provides an easy to use, inexpensive ink dispensing container that enables greater control and efficiency for dispensing printing ink onto a mixing table, printing press, etc., and which enables substantially all the air from within the container to be evacuated quickly and easily to substantially eliminate waste of ink due to skinning.

It further will be understood by those skilled in the art that while the present invention has been discussed in relation to a preferred embodiment, various modifications, changes and additions can be made thereto without departing from the spirit and scope of the invention as set forth in the following claims.

I claim:

1. A container for the storage and delivery of a supply of printing ink, which container can be substantially exhausted of air following removal of a portion of ink from the container to substantially reduce skinning and thus waste, of the ink, said container comprising:

a container body formed from a flexible, substantially air-tight material having a side wall, a sealed first end and an open second end and defining a pouch within which the supply of ink is received, said open second end defining a large diameter opening for said container body;

said container body being formed from a compressible material selected from the group consisting of urethane, chloroprene, buna-N, cloth inserted rubber, elastomeric rubber, flouroelastomers, hyplon, neoprene, nitrile, nylon, lycra, polyurethane, prismatic films, polyolefin films, polyvinylchoride, polyethylene, rubber, polypropylene, polytetraflouroethane, vinyl, viscoelastic fabric, and vinyl laminated fabric;

a collar mounted to said container body at said open second end;

a lid member received over said large diameter opening of said container body, releasably mounted to said collar for enclosing said large diameter opening to enable egress of ink out of said container body and having a base and an upper portion that includes a reduced diameter opening and a cap removably mounted to said lid member for enclosing said reduced diameter opening to provide varying size openings for dispensing ink from said container body;

whereby in use, one of said varying size openings of said container body is exposed, the side wall of said container body is compressed to urge a portion of ink through said open second end from said pouch, thereafter, said cap is removed from said lid member so that said reduced diameter opening is exposed, and said container body is further compressed to substantially exhaust any air remaining between the ink within said container body, said cap is then reapplied over said reduced diameter opening, resealing said container body, to substantially reduce skinning of the ink within said container body.

2. The container of claim 1 and wherein said lid includes a reduced diameter spout for dispensing a reduced volume of ink from said container body.

3. The container of claim 1 and wherein said container body is substantially transparent.

4. The container of claim 1 and wherein said lid has a substantially square configuration.

5. The container of claim 1 and wherein said collar is formed from a substantially rigid plastic material.

6. A method of dispensing printing ink from a storage container of the type having a flexible, compressible side wall, a large diameter opening and a lid releasably attached over the large diameter opening and having side wall and a reduced diameter opening formed therein with a cap releasably attached to the lid over the reduced diameter opening to provide varying size openings for dispensing ink from the container, the method comprising the steps of:

exposing an opening of a desired size in the container depending upon the amount of ink to be dispensed from the container;

applying a force against the compressible side wall of the container sufficient to urge a portion of the printing ink out of the opening;

after a desired portion of the printing ink has been evacuated from the container, removing the cap from the lid, and compressing the side wall of the container with sufficient force to substantially evacuate air remaining within the container from the container through the reduced diameter opening as the container is resealed so as to substantially minimize skinning of the ink within the container due to exposure to air in the container, and reapplying the cap over the reduced diameter opening to seal the container.

7. The method of claim 6 and wherein the step of opening the container comprises removing a lid from the container and exposing an opening for the container.

8. The method of claim 6 and wherein the step of exposing an opening of a desired size includes removing a small diameter cap to open a small diameter orifice.

9. The method of claim 6 and wherein the step of exposing an opening a cap of a desired size includes removing a large diameter lid to expose a large diameter opening of the container for dispensing a substantial portion of the ink of the container.

10. A container for the storage and delivery of a supply of printing ink, which container can be substantially exhausted of air following removal of a portion of ink from the container to substantially reduce skinning and thus waste, of the ink, said container comprising:

a container body formed from a flexible, substantially air-tight, compressible material having a side wall, a sealed first end and an open second end and defining a pouch within which the supply of ink is received, said second end defining a large diameter opening for said container body;

a collar mounted to said container body at said open second end;

a lid received over said large diameter opening of said container body, releasably mounted to said collar to enable a substantial quantity of ink to be dispensed from said container body, and having a reduced diameter opening formed therein for dispensing smaller quantities of ink from said container body to provide varying size openings for said container body, and a cap releasably attached to said lid over said reduced diameter opening;

whereby in use, one of said varying size openings of said container body is exposed and the side wall of said container body is compressed to urge a portion of ink from said pouch, thereafter, said reduced diameter opening is exposed and said container body is further compressed to substantially exhaust air remaining between the ink within said container body and said lid member through said reduced diameter opening, after which said cap is reapplied over said reduced diameter opening to seal said container body and substantially reduce skinning of the ink within said container body.

* * * * *